US006012439A

United States Patent [19]

Woodruff

[11] Patent Number: 6,012,439

[45] Date of Patent: Jan. 11, 2000

[54] ARCHERY BOW SUPPORT MECHANISM

[76] Inventor: Robert E. Woodruff, P.O. Box 223, Beaverton, Mich. 48612

[21] Appl. No.: 09/131,632

[22] Filed: Aug. 10, 1998

[51] Int. Cl.[7] ..... F41B 5/14

[52] U.S. Cl. ..... 124/1; 124/86; 248/309.1

[58] Field of Search ..... 124/23.1, 86, 88, 124/1; 248/309.1

[56] References Cited

U.S. PATENT DOCUMENTS

| | | | |
|---|---|---|---|
| 4,474,296 | 10/1984 | Hartman | 124/23.1 X |
| 4,846,140 | 7/1989 | DiMartino | 248/360 |
| 5,044,590 | 9/1991 | Carafice | 248/309.1 |
| 5,205,272 | 4/1993 | Boyer | 124/89 |
| 5,239,976 | 8/1993 | Specht | 124/88 |
| 5,377,657 | 1/1995 | Foster et al. | 124/86 |
| 5,482,241 | 1/1996 | Oglesby | 124/23.1 X |
| 5,547,162 | 8/1996 | Sobolewski | 248/688 |
| 5,619,981 | 4/1997 | Breedlove | 124/89 |
| 5,630,568 | 5/1997 | Lubrecht | 248/217.4 |

*Primary Examiner*—John A. Ricci
*Attorney, Agent, or Firm*—Charles W. Chandler

[57] ABSTRACT

A compound archery bow equipped with a cable guard can be suspended in front of a seat in an elevated tree stand by a support mechanism attached to the front edge of the seat. The support mechanism includes a mounting bracket attached to the undersurface of the seat, and a support member affixed to the terminal end of the cable guard. The support member has a slide pin adapted for insertion into an open top socket on the mounting bracket, such that the archery bow can be supported in a stable position in front of the hunter. The seated hunter can readily remove the bow from the support mechanism for shooting purposes.

11 Claims, 2 Drawing Sheets

ARCHERY BOW SUPPORT MECHANISM

BACKGROUND AND SUMMARY OF THE INVENTION

This invention relates to a mechanism for supporting a compound archery bow in an upright position on a seat or in other positions on a tree stand platform or other supporting surface such as on a boat for bow fishing, or even from the archer's jacket, whereby the bow is readily available to the archer. The bow-suspending mechanism preferably positions the bow directly in front of the seated archer, so that his hands remain free for various tasks, e.g. holding binoculars, rattling horns, operating video equipment, or rubbing his hands together for warming purposes. The bow is readily available for pick up and handling when necessary.

Various mechanisms have heretofore been devised for supporting archery bows.

U.S. Pat. No. 4,846,140, issued to Paul J. DiMartino, discloses a stand for supporting a compound bow in an upright position above a ground surface. The stand includes a ground-penetrating spike having a swivel connection with a bracket that is clamped to the lower limb of the bow.

U.S. Pat. No. 5,205,272, issued to Bob Boyer, discloses a bow stabilizer that has a Y-shaped terminal end, whereby the stabilizer can be used as a stand for supporting the bow in an inclined position above a ground surface.

U.S. Pat. No. 5,377,657, issued to Foster et al, shows a bow holder formed of wire material bent into a cradle configuration for engaging the terminal end of a bow. The holder has a mounting base for attaching of the holder to the floor of a hunter's tree stand.

U.S. Pat. No. 5,630,568, issued to Edward Lubrecht, shows a bow holder for supporting a bow near a supporting surface, such as a tree trunk or fence post. The holder comprises a sleeve adapted to receive the counterweight of the bow, and a mounting screw for affixing the sleeve to a support surface.

U.S. Pat. No. 5,239,976, granted to J. Specht, shows a bow holder adapted to partially support the weight of a bow at the side of the hunter (archer). The holder comprises a sling trained around the shoulder area of the hunter and a connector clamped to the cable guard of the bow. The connector has a groove that can fit onto the sling, as shown in FIG. 2 of the patent.

U.S. Pat. No. 5,547,162, granted to Eugene R. Sobolewski, discloses a bow stabilizer having a swingable leg that apparently can be used to support the bow. It is not entirely clear how the swingable leg achieves the bow support action.

U.S. Pat. No. 5,619,981, granted to Charles E. Breedlove shows a bow stabilizer having a downwardly extending prop adapted to telescope into a tubular receiver affixed to the floor of a hunter's tree stand for supporting the bow.

The present invention relates to a bow-support mechanism adapted for attachment to the edge of a supporting surface such as on a hunter's seat. It can also be mounted off the side of the seat or mounted on the tree stand at any location that suits the archer/hunter. The support mechanism has an inner end attached to the supporting surface, and an outer end. An upwardly-opening socket is provided on the outer end of the support mechanism for engaging a conventional cable guard on the bow. The socket is designed so that the bow is supported in an upright position directly in front of the archer.

The bow may be supported above the tree stand platform, or between the legs of the archer, such that he can readily grasp the handle of the bow to lift the cable guard out of the socket. While the bow is in the supported position, the archer's hands are free for other tasks, e.g. holding binoculars; he can freely move his arms back and further to relieve arm fatigue or discomfort, without having to disturb the bow or causing the bow to strike the tree stand.

Removing the bow from the support mechanism is easily accomplished by lifting the bow with the cable guard upwardly out of the socket. The operation is essentially noiseless so that game in the vicinity are not alerted to the hunter's presence.

The bow support mechanism may be mounted on support surfaces other than a hunter's tree stand. For example, for a non-climbing hunter it can be mounted on the window sill of a ground blind, or by hooking the cable guard mount inside his jacket from a loop that has been sewn to the hunting jacket. He can let the bow hang by balancing the bow's lower limb against the archer's lower torso or stomach.

The support mechanism can also be connected to a short stabilizer rod in front of the bow that is screwed into the conventional stabilizer mounting hole. The rod permits the bow to be mounted on a surface in front of the bow.

BRIEF DESCRIPTION OF THE DRAWINGS

The description refers to the accompanying drawings in which like reference characters refer to like parts throughout the several views, and in which.

DESCRIPTION OF A PREFERRED EMBODIMENT OF THE INVENTION

Figure 5:
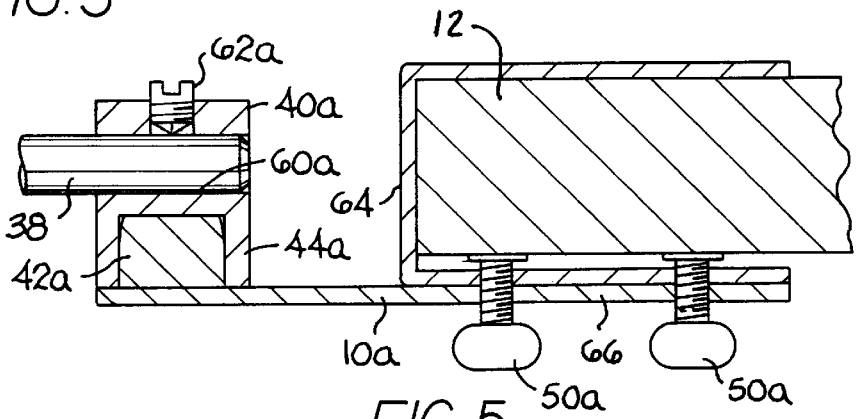
FIG. 5 is a sectional view taken in the same direction as FIG. 2, but showing a further form that the invention can take.
Figure 6:
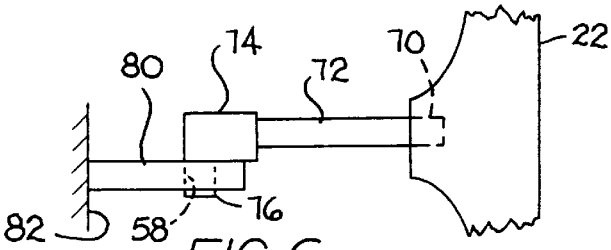
FIG. 6 is a fragmentary view of the support mechanism mounted on a stabilizer rod.

FIGS. 1 through 4 show the presently preferred embodiment of the invention. FIGS. 5 and 6 show other forms that the invention could take.

Figure 1:
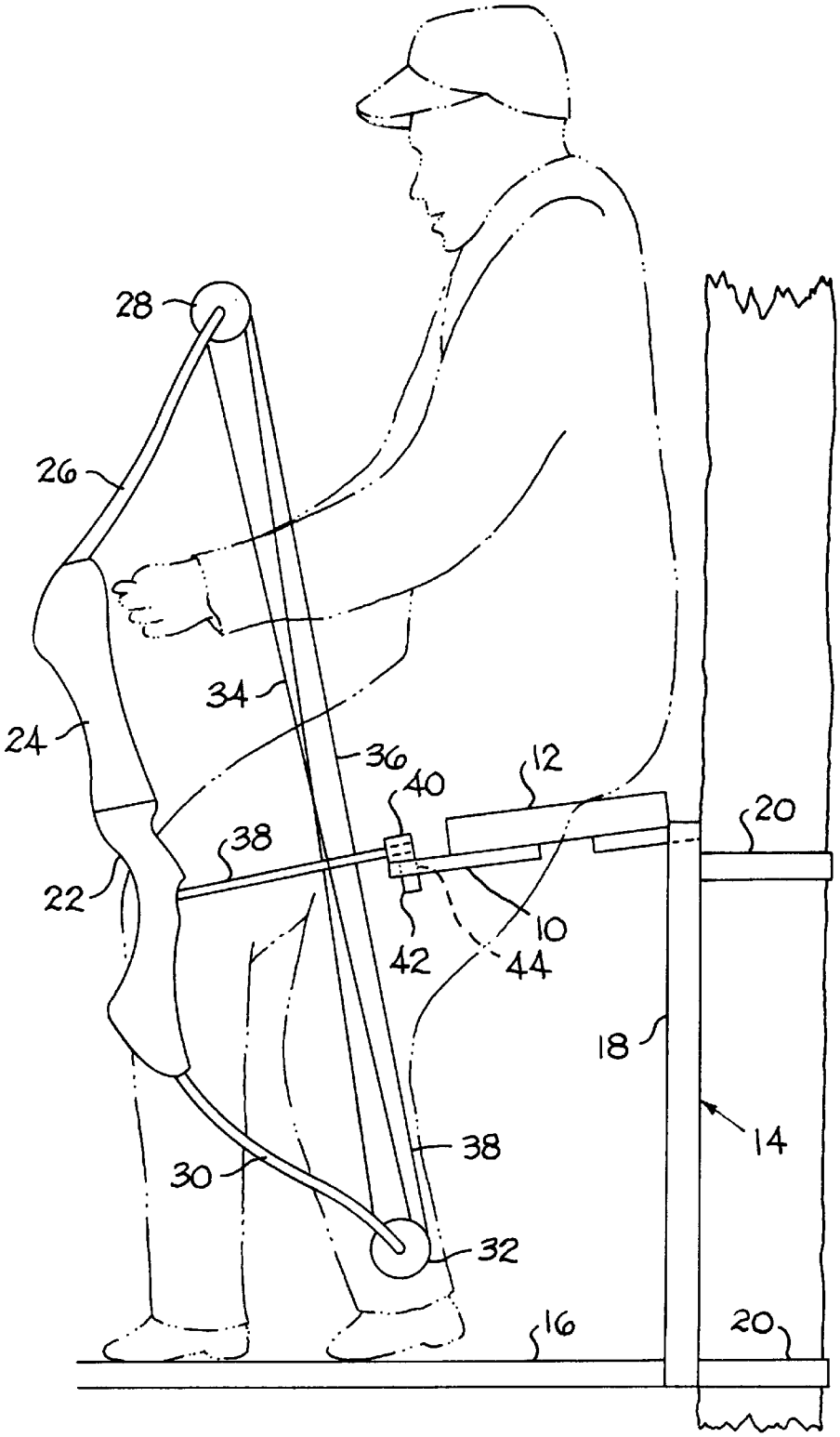
FIG. 1 shows a compound bow supported by a support mechanism constructed according to the invention.

FIG. 1 shows a bow-suspending mechanism that includes a mounting bracket 10 attached to the front edge of a hunter's seat 12 that forms part of a conventional tree stand 14. The stand comprises a floor 16, an upright post structure 18 positioned against the side surface of a tree, and tree-encircling band structure 20 for supporting the stand in an elevated position against the tree trunk. Other supporting structures may be used for holding the bow.

The bow-suspending mechanism can be used to suspend any conventional compound bow in front of the archer, not shown, such as on seat 12. The bow comprises a handle 22, handle riser 24, upper limb 26, top wheel 28, lower limb 30 and lower wheel 32. Cables 34 are trained between wheels 28 and 32 in a plane that is slightly offset from the movement plane of bow string 36. A conventional rod-type cable guard 38 is screwed into the bow below or above handle 22 to ensure that cables 34 will not interfere with the bow string or arrow. The bow is a conventional compound bow used for hunting purposes.

The bow-suspending mechanism, shown in FIGS. 1 through 4, comprises bracket 10 and a support member 40 adapted to releasably fit in a socket means provided on the exposed portion of bracket 10. Support member 40 has a horizontal bore fitting on the end of cable guard 38 so as to become a part of the bow during normal bow operation, e.g. during the arrow launch process. Support member 40 has a downwardly-extending pin 42 adapted to releasably fit into a mating socket hole 44 in bracket 10, such that pin 42 can be lifted out of hole 44 in order to remove the archery bow from the bow-suspending mechanism.

Bracket 10 is preferably located in front of seat 12 such that the bow is suspended in front of the archer seated on the seat. The platform of the stand is unencumbered, such that the archer can shift his feet back and forth without disturbing the bow. The bow is adequately supported without any contact between the archer's hands and the bow. The seated archer has his hands and arms free for various tasks, such as holding binoculars or rubbing his hands together for warming purposes. The suspended bow can be removed from mounting bracket 10 by grasping handle 22 or handle riser 24 and lifting the bow to separate pin 42 from socket hole 44.

The supporting bracket can be mounted in other locations on the tree stand that are convenient to the archer.

Figure 2:
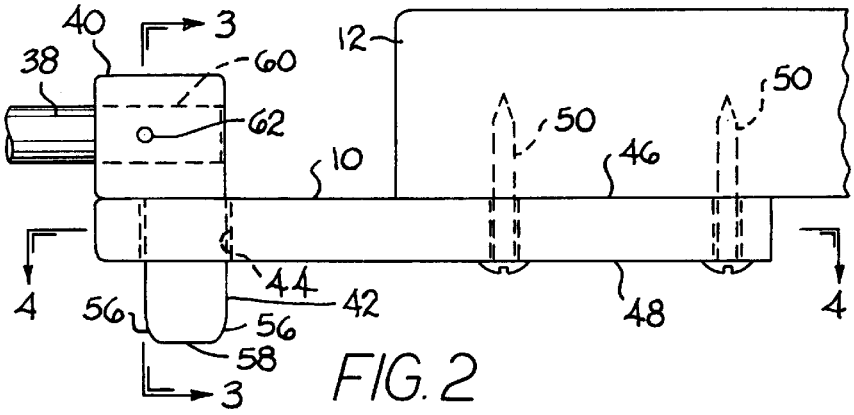
FIG. 2 is a side elevational view of the support mechanism shown in FIG. 1, taken on an enlarged scale to show features not apparent in FIG. 1.
Figure 3:
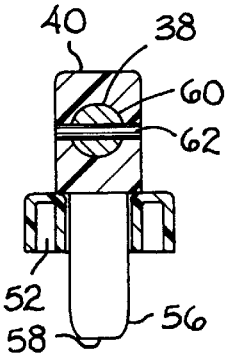
FIG. 3 is a sectional view taken on line 3—3 in FIG. 2.
Figure 4:
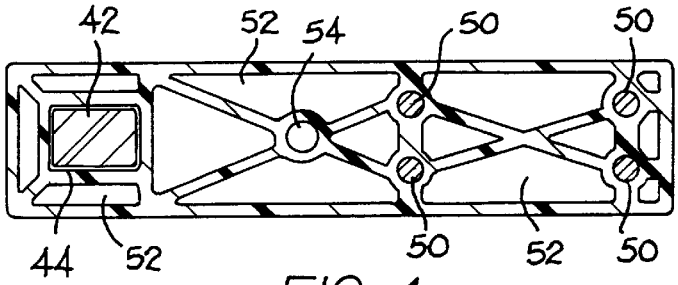
FIG. 4 is a sectional view taken on line 4—4 in FIG. 2.

FIGS. 2 through 4 show some features of the bow-suspending mechanism not apparent in FIG. 1. As shown in FIG. 2, bracket 10 comprises a flat rectangular bar having a flat upper surface 46 adapted to abut the undersurface of seat 12, and a flat lower surface 48. The vertical thickness of bracket 10 is approximately one half inch. The bracket is attached to seat 12 by four screws 50 extending through pre-formed holes in the bracket.

The bracket is preferably formed as a plastic molding. In order to reduce the weight of the molding, and to reduce the volume of material used, lower surface 48 has plural cavities molded therein as part of the molding operation. In FIG. 4, these cavities are referenced by numeral 52.

Bracket 10 could be attached to the undersurface of seat 12 by other types of screws, bolts, clamps, etc. As shown in FIG. 4, bracket 10 has a threaded hole 54 adapted to receive a mounting bolt, not shown. The mounting bolt could be used instead of screws 50 for attaching the bracket to a non-wood tree stand.

Socket hole 44 has a rectangular cross section sized to slidably fit the similarly configured pin 42 that extends downwardly from support member 40. Hole 44 thus functions as a guide element, while pin 42 functions as a slide element capable of telescopic movement into the socket hole. In order to facilitate entry of pin 42 into socket hole 44, the corner areas 56 between the flat side surfaces of pin 42 and lower end surface 58 of the pin are rounded, as shown in FIGS. 2 and 3.

The socket hole and pin 42 can have other suitable shapes such as round, star shaped, diamond shaped etc.

Support member 40 can be attached to cable guard 38 by various types of connectors. As shown in FIGS. 2 and 3, support member 40 has a horizontal bore 60 fitting snugly on the cylindrical side surface of cable guard 38. A roll pin 62 extends through aligned holes in the support member and cable guard to affix them together. The roll pin can be driven out of the aligned holes should it be necessary to separate member 40 from the cable guard.

Support member 40 is preferably formed as a plastic molding. Cavities can be formed in member 40 to reduce the volume of material used. The use of plastic for members 10 and 40 is advantageous in that as pin 42 is slid, up or down, in socket hole 44, the movement is essentially noiseless. The bow can be moved to or from the suspended position without alerting game in the vicinity that the hunter is present in the tree stand. Pin 42 and socket hole 44 preferably have non-circular e.g. rectangular cross-sections in order to keep the suspended bow in a stable position.

FIG. 5 shows a second form that the support mechanism can take. Mounting bracket 10*a* comprises a metal channel 64 welded or otherwise secured to a flat metal plate 66. Two clamp screws 50*a* extend through threaded openings in the plates to removably secure bracket 10*a* to seat 12.

An upwardly-extending pin 42*a* is welded, or otherwise secured, to the exposed portion of bracket 10*a* in front of seat 12 for slidable interaction with a downwardly-extending sleeve 44*a* provided on support member 40*a*. Pin 42*a* and sleeve 44*a* have mating rectangular cross sections, such that support member 40*a* is prevented from turning or rotating around the pin 42*a* axis.

Support member 40*a* has a horizontal bore 60*a* fitting snugly on the cylindrical side surface of cable guard 38, whereby the support member 40*a* is attached to the cable guard. A set screw 62*a* prevents support member 40*a* from turning or otherwise separating from the cable guard.

In service, the FIG. 5 support mechanism functions in essentially the same fashion as the support mechanism shown in FIG. 2. Pin 42*a* serves as a negative socket to slidably accommodate sleeve 44*a* of support member 40*a*, whereby the bow is suspended from the support mechanism in essentially the same fashion as previously described. The FIG. 5 mechanism may be considered a reversal of parts of the mechanism depicted in FIG. 2. In FIG. 2 the rectangular pin is located on the support member attached to cable guard 38, whereas in FIG. 5 the rectangular pin is located on the mounting bracket.

In each of the above embodiments of the invention, the mounting bracket has a normally concealed portion adapted to underlie the hunter's seat, and a normally exposed portion adapted to extend beyond the front edge of the hunter's seat. In each case the mounting bracket provides an upwardly-opening socket means for supportive interaction with the cable guard of an archery bow, such that the bow is suspended in an upright position in front of the hunter's seat. The socket means, in each case, is constructed so that the bow can be removed by lifting the cable guard out of a position supported by the socket means.

FIG. 6 shows another embodiment of the invention. In this case, bow handle 22 has a conventional threaded stabilizer hole 70. A short rod 72 has one end threadably mounted in threaded hole 70. Support member 74, identical to support member 40, has a downward extending pin 76 releasably received into a socket 78 of a support bracket 80. Support bracket 80 may be attached by any suitable means to a support surface 82 such as the sill of a ground mounted deer blind. In this case the support bracket is forward of the archery bow while still permitting the archer to separate the bow from the bracket by raising the bow to remove the pin from socket 78.

The invention could also be employed by sewing a loop or other similar structure which would be the equivalent of bracket 44 onto the archer's clothes. The archer can then insert the pin of the mounting bracket into the loosely held socket. The archer can then hang the bow from his clothing with the lower limb of the bow in contact with his lower torso thereby permitting the archer's hands to be free.

Having described my invention, I claim:

1. A mechanism for suspending a compound archery bow in an upright position on a hunter's tree stand, comprising:

a mounting bracket adapted for attachment to the front edge of a hunter's seat; and a support member adapted for telescopic attachment to the cable guard of an archery bow;

said mounting bracket having an upwardly facing guide element positionable proximate to the front edge of a hunter's seat;

said support member having a downwardly-extending slide element adapted for telescopic positionment on said guide element, whereby the archery bow can be removed from the suspending mechanism by lifting said slide element from said guide element.

2. The mechanism of claim 1, wherein said slide element comprises a pin, and said guide element comprises a hole having a telescopic fit on said pin.

3. The mechanism of claim 2, wherein said guide element has a rectangular pin hole having flat side surfaces and a lower end surface; said pin having rounded corners joining said flat side surfaces to said end surface to facilitate entry of said pin into said rectangular hole.

4. The mechanism of claim 1, wherein said support member has a horizontal bore adapted to fit onto the cable guard of an archery bow;

said slide element comprising a rectangular cross-sectioned pin extending downwardly from said support pin;

said pin having a vertical axis, and said bore having a horizontal axis that intersects the pin axis.

5. The mechanism of claim 1, and further comprising a roll pin extending through said support member transverse to said horizontal bore for releasably attaching said support member to the cable guard.

6. The mechanism of claim 1, wherein said mounting bracket comprises a rectangular bar having a flat upper surface adapted to seat against the undersurface of a hunter's seat.

7. The mechanism of claim 6, in which said rectangular bar has a normally concealed end portion adapted to underlie the hunter's seat and a normally exposed end portion adapted to extend beyond the front edge of the hunter's seat.

8. The mechanism of claim 7, wherein said upwardly facing guide element comprises a rectangular hole in the normally exposed end portion of said rectangular bar.

9. The mechanism of claim 8, wherein said rectangular bar has a flat lower surface; said flat lower surface having plural cavities therein for reducing the volume of material used to form said bar.

10. The mechanism of claim 9, wherein said rectangular bar is a plastic molding.

11. A mechanism for suspending a compound archery bow in an upright position on a supporting structure, comprising:

a bow mounting means having a socket;

an archery bow having a stabilizer mounting hole;

a rod having a first end threadably received in said stabilizer mounting hole so that an opposite second end of the rod extends forwardly of the bow; and structure on the second end of the rod releasably receivable in the socket of the mounting means so that the bow can be removed therefrom by lifting the rod out of a position in which the bow is supported by said socket.

* * * * *